US006799450B2

(12) United States Patent
Brinas et al.

(10) Patent No.: US 6,799,450 B2
(45) Date of Patent: Oct. 5, 2004

(54) METHOD OF STRETCH FORMING AN ALUMINUM METAL SHEET AND HANDLING EQUIPMENT FOR DOING THE SAME

(75) Inventors: Nelson T. Brinas, Sterling Heights, MI (US); Edward Frank Ryntz, Warren, WI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/269,658

(22) Filed: Oct. 11, 2002

(65) Prior Publication Data

US 2004/0069038 A1 Apr. 15, 2004

(51) Int. Cl.[7] ..... B21D 37/16

(52) U.S. Cl. ..... 72/342.2; 72/342.5; 72/405.09; 72/405.16; 72/422; 72/701

(58) Field of Search ..... 72/701, 342.2, 72/342.5, 342.6, 342.94, 700, 405.01, 405.09, 405.11, 405.12, 405.13, 405.16, 419, 420, 422

(56) References Cited

U.S. PATENT DOCUMENTS

| | | | | | |
|---|---|---|---|---|---|
| 4,449,390 | A | * | 5/1984 | Pontini | 72/405.09 |
| 4,658,362 | A | * | 4/1987 | Bhatt | 700/145 |
| 5,016,805 | A | * | 5/1991 | Cadwell | 228/118 |
| 5,236,525 | A | * | 8/1993 | Anton | 148/564 |
| 5,819,572 | A | | 10/1998 | Krajewski | 72/42 |
| 5,941,446 | A | | 8/1999 | Yasui | 228/157 |
| 5,974,847 | A | | 11/1999 | Saunders et al. | 72/57 |
| 6,047,583 | A | | 4/2000 | Schroth | 72/60 |
| 6,085,571 | A | | 7/2000 | Brinas et al. | 72/420 |
| 6,253,588 | B1 | | 7/2001 | Rashid et al. | 72/57 |
| 6,305,202 | B1 | | 10/2001 | Kleber | 72/57 |
| 6,619,094 | B2 | * | 9/2003 | Juhl | 72/296 |

* cited by examiner

*Primary Examiner*—Ed Tolan
(74) *Attorney, Agent, or Firm*—Kathryn A. Marra

(57) ABSTRACT

A method of stretch forming an aluminum metal sheet that includes the steps of placing an aluminum metal sheet in a hot forming tool, forming a shaped part at an elevated temperature, removing the hot shaped part from the forming tool, and thereafter transferring the hot shaped part to a cooling fixture. The transfer and removal steps are performed at a speed that is variable based on a correlation of the temperature and strength of the aluminum metal sheet and the speed at which the hot shaped part may be transferred without distortion of its shape due to inertia.

20 Claims, 2 Drawing Sheets

METHOD OF STRETCH FORMING AN ALUMINUM METAL SHEET AND HANDLING EQUIPMENT FOR DOING THE SAME

TECHNICAL FIELD

This invention relates to stretch forming aluminum metal sheets into formed shapes, and more particularly the invention relates to a method of stretch forming an aluminum metal sheet utilizing a removal device such that a formed part is created without distortion.

BACKGROUND OF THE INVENTION

Automobile body panels are typically made by shaping low carbon steel or aluminum alloy sheet stock into desired panel shapes. Sheet panels may be made by using conventional stamping technology or alternative methods such as superplastic forming (SPF) processes and quick plastic forming (QPF) processes. The above-referenced plastic forming processes have the advantage of creating complex shaped parts from a single sheet of material. Such plastic forming processes eliminate the need for joining several panels formed in a stamping process to create an overall panel assembly.

Superplastic forming processes generally utilize a metal alloy, for example, aluminum or titanium alloys that have high ductility when deformed under controlled conditions. Such metal alloys are capable of extensive deformation under relatively low shaping forces. Superplastic alloys are characterized by having tensile ductility in the range of from 200 to 1,000 percent elongation. The plastic forming processes may utilize large aluminum alloy sheets to form outer or inner outer panels of an automotive structure. Such a process involves heating the aluminum alloy sheets to a forming temperature in the range of from 400° C. to 510° C. and then stretch forming the sheet against a forming tool utilizing high pressure gas. The low flow stress of the aluminum alloy at the elevated forming temperature is beneficial when forming the part, but may be a hindrance when removing the part from a die. Removal of the parts at elevated temperatures, particularly utilizing a manual operation, may result in distortion of a part that either requires corrective action to accurately reshape the part, or may result in scraping of the part. Therefore, there is a need in the art for a method of stretch forming an aluminum metal sheet such that accurate part dimensions can be maintained when removing the part from a die.

SUMMARY OF THE INVENTION

There is disclosed a method of stretch forming an aluminum metal sheet including the steps of:

(a) Placing the aluminum metal sheet in a hot forming tool;

(b) Forming a shaped part at an elevated temperature such that the shaped part is hot;

(c) Removing the hot shaped part from the hot forming tool; and (d) Transferring the hot shaped part to a cooling fixture.

The transfer step is performed at a variable speed based on a correlation of the temperature and strength of the aluminum metal sheet and the speed at which the hot shaped part may be transferred without distortion of its shape. The removal step is performed at a speed and utilizing a removal device, again such that the shape of the hot shaped part is not distorted.

The method disclosed by the present invention has the advantage of providing a method of stretch forming an aluminum metal sheet such that the part shape is not distorted during a removal of the hot shape part from a hot forming tool, and during a transfer step wherein the hot shaped part is placed on a cooling fixture.

DESCRIPTION OF THE PREFERRED EMBODIMENT

Figure 1:
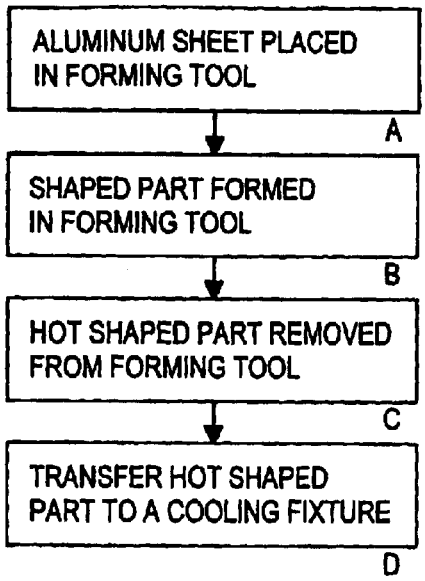
FIG. 1 is a flow diagram detailing the steps of the method of the present invention.

In a first aspect of the invention, and with reference to FIG. 1, there is shown a flow diagram detailing the method of stretch forming an aluminum metal sheet according to the method of the present invention. As can be seen in Block A of FIG. 1, an aluminum metal sheet is placed in a hot forming tool, then as shown in step B, a shaped part is formed at an elevated temperature resulting in a hot shaped part. Then, as detailed in step C, the hot shaped part is removed from the hot forming tool, utilizing a removal device, as will be discussed in more detail below. The hot shaped part, is then transferred, as shown in Block D of FIG. 1 to a cooling fixture.

The removal and transfer steps of Block C and D are performed at a speed that is based on a correlation of the temperature and strength of the aluminum sheet and the speed at which the hot shaped part may be transferred or removed without distortion of its shape.

Many factors are taken into account when determining an overall cycle time of a stretch forming operation. Such factors include, an overall rate of producing hot formed parts such that the process is economical, the overall time necessary to stretch-form the hot shaped part in a hot forming tool, the necessary time for cooling the hot shaped part such that it may be removed from the hot forming tool with a greater strength, and the amount of time required to move the hot shaped part to a cooling fixture. Factors affecting the above recited time requirements, as well as other economic considerations are to be optimized for a given hot shaped part, such that a stretch forming operation is performed in an economical manner.

Figure 5:
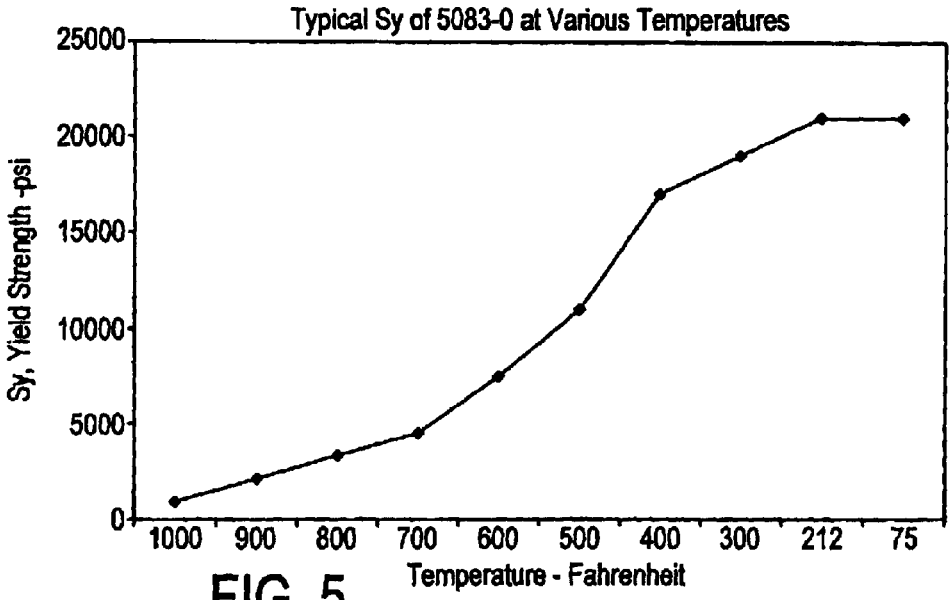
FIG. 5 is a plot of the yield strength and temperature for a deck-lid produced by the method of the present invention.

With reference to FIG. 5, there is shown a plot of the yield strength as a function of temperature for 5083 aluminum in a quick plastic forming process. As can be seen from the figure, the yield strength increases over time from approximately 2,000 psi at 1,000° F. to above 20,000 psi at 212° F. Again, as is to be expected, the temperature of a formed part decreases in a somewhat linear fashion over a time period, thereby increasing the yield strength. Therefore, in an effort to optimize the method of stretch forming of the present invention, it is desirable to allow the hot shaped part to cool to as low a temperature as possible within the tool, thus providing a hot formed part having an increased yield strength. The amount of time that the hot formed part is allowed to cool, is limited by the need to form hot shaped parts within the hot forming tool at an economical rate.

In an effort to optimize the stretch forming operation, the method of the present invention includes a step of cooling the hot shaped part prior to removing the hot shaped part from the hot forming tool. The cooling step may be performed by separating a hot shaped part from the forming tool, thereby allowing less heat transfer from the hot die surface. The cooling step may also be performed by applying forced air onto the hot shaped part, thereby increasing the overall cooling rate of the part. The forced air may be provided by blowing air through vent holes formed in the die of the hot forming tool or through nozzles that are attached to the removable device, which will be discussed in more detail below. Regardless of the method of cooling utilized by the present invention, the cooling of the hot shaped part prior to the step of removing the hot shaped part from the hot forming tool decreases the likelihood of distortion of the shape of the part, as well as increases the speed at which the hot shaped part may be moved.

Figure 6:
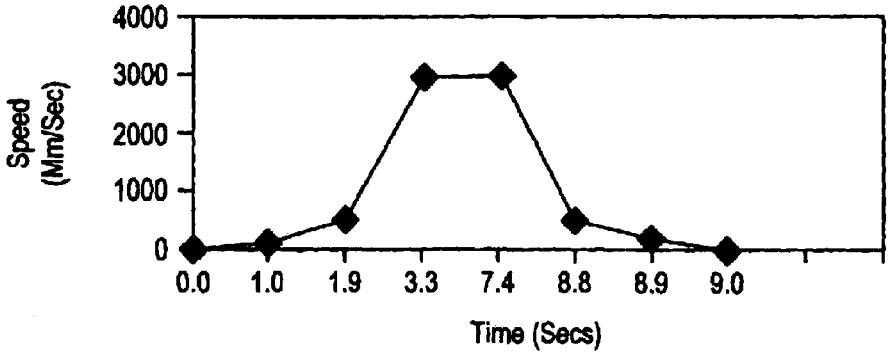
FIG. 6 is a plot of the speed at which the deck-lid of FIG. 5 may be moved without distortion as a function of time.

With reference to FIG. 6, there is shown a plot of the speed at which a hot shaped part may be moved as a function of time. As can be seen from the Figure, there is a slow ramp up in speed until the panel has sufficient strength, such that inertia effects do not distort the shape of the part. It should be realized that varying curves may be developed dependent upon the type of panel being produced. For example, a panel having a greater thickness or a specific geometric shape may inherently have a greater stiffness such that it can be moved at a faster speed without distortion of the shape of the part. Therefore, the step of removing the hot shaped part is performed at a speed that is determined by the temperature and strength of the hot shaped part as a function of time which dictates the speed at which the hot shaped part may be moved without distortion of the shape due to inertia effects.

As stated above, the method of the present invention utilizes a removal device for removing the hot shaped part from a tool, as well as for transferring the hot shaped part to a cooling fixture. The removal device is formed of a low density material that has a high section modulus. Preferably, the low density material has a deflection of less than 1 mm at an operating temperature associated with the hot forming tool. Materials suitable for use as the low density material include aluminum and titanium. The requirement of a deflection of less than 1 mm ensures that the shape of the part will not be distorted due to changes of the shape of a removal device.

Figure 2:
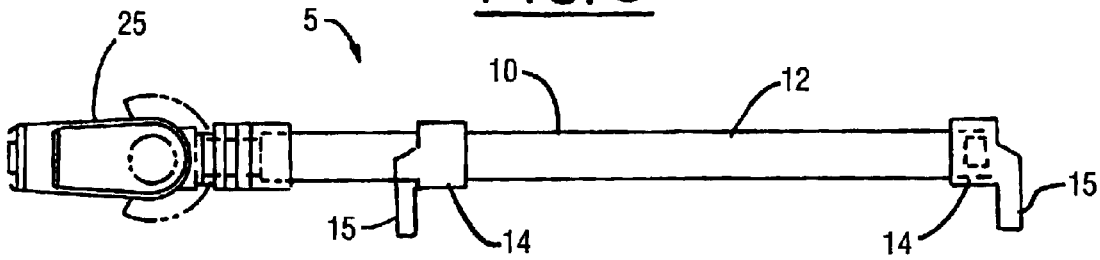
FIG. 2 is a front view of a removal device coupled to a robotic arm used in the method of the present invention.

With reference to FIG. 2, there is shown a removal device 5 suitable for use in the method of the present invention. The removal device 5 includes a support structure 10 that is formed of the low density material discussed above. Attached to the support structure 10 are gripping elements 15 for engaging the hot shaped part. The gripping elements 15 are preferably formed of a lightweight heat resistant material. Suitable materials for the gripping elements include metals, such as, aluminum and titanium, and ceramics, such as graphite and boron nitride.

As detailed in FIG. 2, the support structure includes a boom 12 having intersecting arms 14 from which the gripping elements 15 suspend. It is to be understood that other orientations of the support structure may be utilized with the present invention without departing from the inventive aspect of the method.

In a preferred aspect of the invention, the gripping elements 15 include a pneumatic mechanism 20 for actuating the gripping elements 15 from engaged and disengaged positions with respect to the hot shaped part 30. The pneumatic mechanism, should include necessary components, such as air lines that have been designed to resist the elevated temperatures associated with the stretch forming operation. Although a pneumatic mechanism is disclosed in a preferred aspect of the removal device, other actuating systems such as hydraulic, electronic or solenoid based actuators may be utilized by the present invention.

The removal device 5 is preferably attached to a robot 25 for accurately moving the removal device 5 utilized in the method of the invention. Typical manufacturing robots may include a robotic arm terminating in a wrist that allows for movement in various axes. Preferably, the removal device 5 is coupled to the robot 25 such that the gripping elements 15 are positioned symmetrically with respect to an axis of a wrist of the robot.

Figure 3:
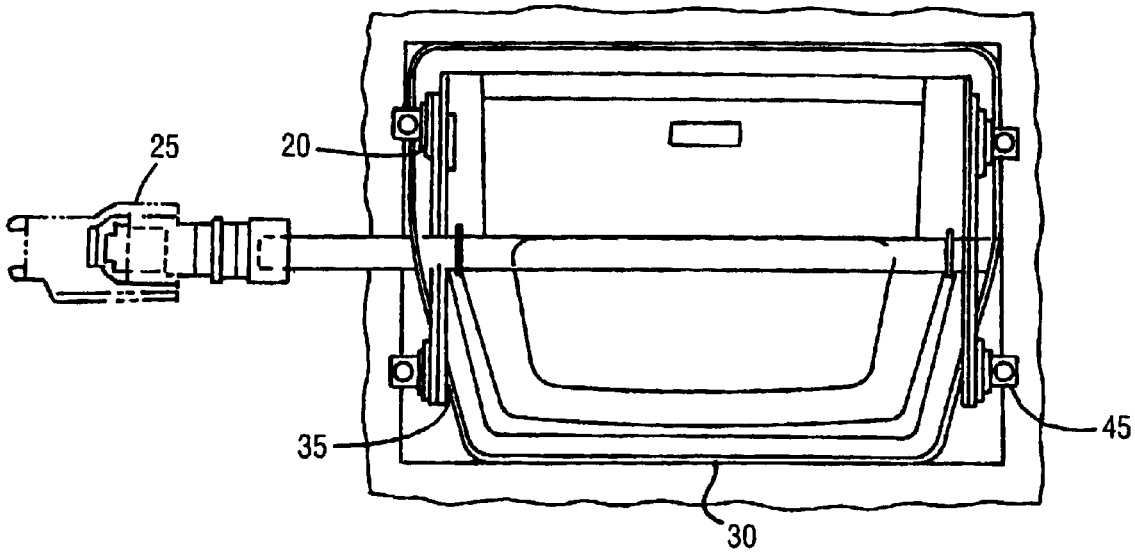
FIG. 3 is a partial plan view of a removal device engaging a formed part as disclosed in the method of the present invention.
Figure 4:
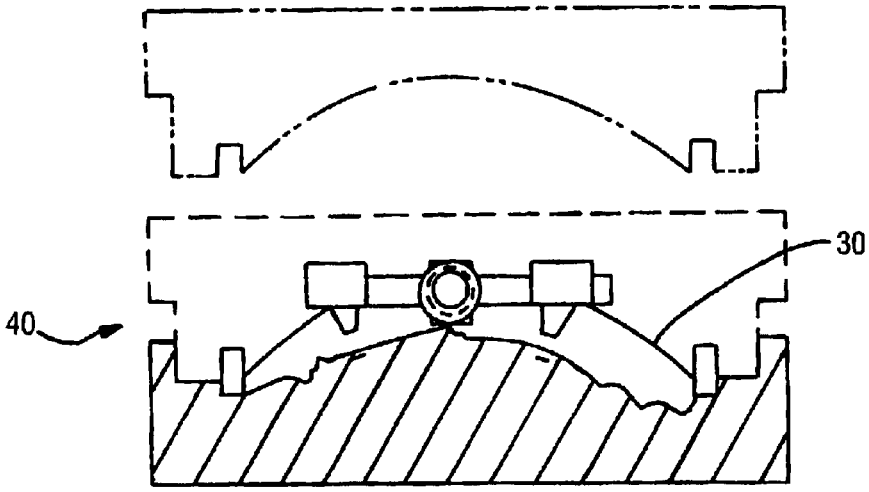
FIG. 4 is an end view detailing a forming press in open and closed positions, as well as a removal device engaging the formed part as disclosed in the method of the present invention

With reference to FIGS. 3 and 4, the removal device 5 is shown engaging a hot shaped part 30 in a plan view, and end view for FIGS. 3 and 4, respectively. The gripping elements 15 preferably engage the hot shaped part 30 normal to a surface of the hot shaped part to prevent twisting or distortion of the hot shaped part 30 from the engagement with the gripping elements 15. Preferably, the hot shaped part 30 includes contact points 35 for engagement with the gripping elements 15. The contact points 35 are located on the part such that the part is balanced when the gripping elements 15 engage the contact points 35. Again, the positioning of engagement of the gripping elements 15 for a specific part will vary depending on the overall shape and structure of the part. By maintaining a balanced orientation at the contact points 35 of the hot shaped part 30, the part will not become distorted in the removal and transfer steps of the method of the present invention.

The hot forming tool 40 as represented in FIGS. 3 and 4, preferably includes notches 45 placed on the die structure such that there is sufficient material for example, at least one inch, of the hot shaped part 30 exposed at its contact points 35 to facilitate engagement of the gripping elements 15 at the contact points 35.

While preferred embodiments are disclosed, a worker in this art would understand that various modifications would come within the scope of the invention. Thus, the following claims should be studied to determine the true scope and content of this invention.

What is claimed is:

1. A method of stretch forming an aluminum metal sheet comprising the steps of:

a) placing an aluminum metal sheet in a hot forming tool;

b) forming a shaped part at an elevated temperature such that the shaped part is hot;

c) removing the hot shaped part from the hot forming tool as it is being cooled from said elevated temperature;

d) transferring the hot shaped part to a cooling fixture; the transfer step being performed at a variable speed based on a correlation of the temperature and strength of the aluminum metal sheet and the speed at which the hot shaped part may be transferred without distortion of its shape.

2. The method of claim 1 wherein the step of removing the hot shaped part further includes the step of cooling the hot shaped part prior to removing the hot shaped part from the hot forming tool.

3. The method of claim 2 wherein the step of cooling the hot shaped part is performed by separating the hot shaped part from the hot forming tool.

4. The method of claim 2 wherein the step of cooling the hot shaped part is performed by applying forced air through the hot forming tool onto the hot shaped part.

5. The method of claim 2 wherein the step of cooling the hot shaped part is completed in a time period resulting in a maximum strength of the hot shaped part for an overall cycle time of the hot forming tool.

6. The method of claim 1 wherein the hot shaped part is removed from the hot forming tool at a speed such that the shape of the hot shaped part is not distorted.

7. The method of claim 6 wherein the hot shaped part is removed from the hot forming tool at a speed that is determined by the temperature and strength of the hot shaped part as a function of time.

8. The method of claim 1 wherein the hot shaped part is removed from the hot forming tool utilizing a removal device formed of a low density material having a high section modulus.

9. The method of claim 8 wherein the low density material has a deflection of less than 1 millimeter at an operating temperature of the hot forming tool.

10. The method of claim 8 wherein the low density material is selected from the group consisting of aluminum and titanium.

11. The method of claim 8 in which cooling air is blown on the hot shaped part by said removal device.

12. The method of claim 8 wherein the removal tool includes gripping elements for engaging the hot shaped part.

13. The method of claim 12 wherein the gripping elements are formed of a lightweight, heat resistant material.

14. The method of claim 13 wherein the material of the gripping element is selected from the group consisting of: aluminum, titanium, graphite and boron nitride.

15. The method of claim 12 wherein the gripping elements further include a pneumatic mechanism for actuating the gripping elements from engaged and disengaged positions with respect to the hot shaped part.

16. The method of claim 12 wherein the gripping elements engage the hot shaped part normal to a surface of the hot shaped part to prevent twisting of the hot shaped part.

17. The method of claim 12 wherein the gripping elements are positioned symmetrically with respect to an axis of a wrist of a robot associated with the removal device.

18. The method of claim 12 wherein the hot shaped part includes contact points that are located on the part such that the hot shaped part is balanced when the gripping elements engage the contact points of the hot shaped part.

19. The method of claim 18 wherein the hot forming tool includes notches formed therein, the notches placed such that there is sufficient material of the hot shaped part exposed at its contact points for facilitating engagement of the gripping elements with the contact points.

20. A method of stretch forming an aluminum metal sheet comprising the steps of:

a) placing an aluminum metal sheet in a hot forming tool;

b) forming a shaped part at an elevated temperature such that the shaped part is hot;

c) removing the hot shaped part from the hot forming tool as it is being cooled from said elevated temperature;

d) transferring the hot shaped part to a cooling fixture;

the removal step being performed at a speed and utilizing a removal device such that the shape of the hot shaped part is not distorted.

* * * * *